US005390863A

United States Patent [19]

Tondo

[11] Patent Number: 5,390,863

[45] Date of Patent: Feb. 21, 1995

[54] REFUSE DISPOSAL AND RECYCLING APPARATUS FOR HIGH RISE BULDINGS

[76] Inventor: Frank Tondo, 19 Grey Ave., Allendale, N.J. 07514

[21] Appl. No.: 53,455

[22] Filed: Apr. 27, 1993

[51] Int. Cl.[6] ..... B02C 25/00

[52] U.S. Cl. ..... 241/36; 241/100; 241/260.1; 241/DIG. 38

[58] Field of Search ..... 241/33, 36, 260.1, 100, 241/DIG. 38; 53/282, 276, 503; 141/21, 95, 129, 139, 153, 180, 195, 198

[56] References Cited

U.S. PATENT DOCUMENTS

| | | | |
|---|---|---|---|
| 2,324,765 | 7/1943 | Clifcorn | 141/139 X |
| 2,389,268 | 11/1945 | McKinnis | 141/139 X |
| 3,028,713 | 4/1962 | Kennedy et al. | 53/251 |
| 3,448,778 | 6/1969 | Ramsay | 141/153 X |
| 4,073,372 | 2/1978 | List | 53/282 X |
| 4,715,412 | 12/1987 | Perazzo | 141/129 X |
| 4,789,016 | 12/1988 | Mihail | 141/83 X |
| 5,139,205 | 8/1992 | Gallagher et al. | 241/33 |
| 5,150,613 | 9/1992 | Etheridge | 241/33 X |
| 5,217,173 | 6/1993 | Koenig | 241/33 |

OTHER PUBLICATIONS

"HRS The Hi-Rise Recycling System", Hi-Rise Recycling Systems, Inc. of Miami, Fla. (Brochure).

*Primary Examiner*—Timothy V. Eley
*Attorney, Agent, or Firm*—Richard M. Goldberg

[57] ABSTRACT

A refuse disposal and recycling apparatus for use with a high rise building having a refuse chute, the apparatus including a carousel holding a plurality of refuse bins thereon, including a deposit position directly beneath the open, lower end of the chute, the carousel including a top plate on which the bins are positioned; a rotatable drive assembly for rotatably driving the carousel; an input conveyor for conveying empty refuse bins, onto the carousel; an output conveyor for conveying filled refuse bins from the carousel; a bin level sensor for sensing when a bin is filled to a predetermined level; a timer for setting predetermined time periods; a rotational position sensor for determining a position of the carousel; a control circuit for controlling the rotatable drive to rotate the carousel so as to move an empty bin to the deposit position at the predetermined time periods and when a bin at the deposit position is filled to the predetermined level; and a deflection wall positioned above the top plate for forcing filled bins from the top plate to the output conveyor.

22 Claims, 6 Drawing Sheets

REFUSE DISPOSAL AND RECYCLING APPARATUS FOR HIGH RISE BULDINGS

BACKGROUND OF THE INVENTION

The present invention relates generally to refuse disposal and recycling systems, and more particularly, is directed to a refuse disposal and recycling apparatus for high rise buildings.

Because of environmental and monetary reasons, many laws have been passed, requiring recycling of different types of refuse. However, because of the different types of refuse, it is necessary that the refuse be separated. For individual homeowners with relatively small amounts of refuse, this is a relatively easy task. However, in high rise apartment buildings, this becomes more complicated.

Specifically, high rise apartment buildings generally include a refuse chute that extends the length of the building. The refuse chute is accessible from each floor in order for the residents to deposit refuse therein, and terminates in the basement or other lower level. Therefore, all refuse is deposited in the chute, regardless of the different types of refuse. In order to recycle the refuse, the different types of refuse which fall through the chute to the basement must be separated by an employee of the building. This becomes burdensome, time-consuming and costly.

Alternatively, separate refuse bins for the different types of refuse are placed in a garbage room on each floor, by which the residents are requested to separate the refuse. As a result, only the non-recyclable refuse is supplied to the refuse chute. However, this requires an employee of the building to periodically empty the refuse bins on each floor, which becomes burdensome, time-consuming and costly, particularly in buildings containing a large number of floors. Further, because of the many varied types of refuse, for example, paper, aluminum, plastic, glass bottles and the like, the number of refuse bins that would be required on each floor would occupy a great amount of space.

A recycling system for high rise apartment buildings that seeks to overcome the aforementioned problems is sold by Hi-Rise Recycling Systems, Inc. of Miami, Fla. under the trademark "Hi-Rise Recycling System". In this system, a carousel is positioned at the bottom of the refuse chute, and a plurality of pie or sector-shaped bins are arranged on the carousel, with each bin corresponding to a different refuse item. When a resident of the apartment building desires to empty refuse down the chute, the resident pushes a button on a control panel in the refuse room on that floor, corresponding to the type of refuse the resident wants to deposit down the chute. For example, if paper is to be deposited down the chute, the resident pushes the button on the control panel corresponding to paper. As a result, a signal is sent to a rotational drive motor for the carousel so as to rotate the carousel until the sector-shaped paper bin is positioned below the refuse chute. When the paper bin is properly positioned below the refuse chute, a door to the chute can be opened by the resident to deposit the refuse therein.

However, this system has some severe drawbacks. First, because of the use of sector-shaped bins, the bins must be manually placed on and removed from the carousel by an employee of the building. Because the bins are rather heavy, the bins are mounted on rollers, which further adds to the cost of the system. This detracts from the automatic nature of the system. Second, each time that a bin is filled, regardless of the filled capacity of the other bins, the filled bin must be removed, and the system must be shut down. Third, because the bins that are used are sector-shaped, they are not of a conventional type which are amenable to emptying into a garbage truck by an automatic unloading apparatus. Fourth, when the system is being used by one resident with one type of refuse, it cannot be used by another resident for a different type of refuse. Thus, for example, if one resident on one floor is arranging the paper bin below the chute, one or more residents may be awaiting use of the system for other types of refuse, which is inefficient. Fifth, because of the control panel on each floor and the electronic circuitry associated therewith, the system is relatively complex and costly to manufacture and operate.

OBJECTS AND SUMMARY OF THE INVENTION

Accordingly, it is an object of the present invention to provide a refuse disposal and recycling apparatus for high rise buildings that overcomes the problems with the aforementioned prior art.

It is another object of the present invention to provide a refuse disposal and recycling apparatus for high rise buildings which is fully automatic.

It is still another object of the present invention to provide a refuse disposal and recycling apparatus for high rise buildings which uses conventional barrel-shaped bins that are automatically deposited on and removed from a carousel positioned below the refuse chute.

It is yet another object of the present invention to provide a refuse disposal and recycling apparatus for high rise buildings in which an empty bin automatically replaces a bin under the refuse chute that is filled to a predetermined level.

It is a further object of the present invention to provide a refuse disposal and recycling apparatus for high rise buildings in which a plurality of residents can use the system at the same time, provided that the same type of refuse is being deposited within the chute.

It is a still further object of the present invention to provide a refuse disposal and recycling apparatus for high rise buildings that is relatively economical to manufacture and use, while using an existing refuse chute of a high rise building.

In accordance with an aspect of the present invention, a refuse disposal and recycling apparatus for use with a high rise building having a refuse chute that is accessible from a plurality of different floors of the building and which is open at a lower end thereof, includes carousel means for holding a plurality of refuse bins thereon at a plurality of different positions, the different positions including a deposit position directly beneath the open, lower end of the refuse chute; drive means for moving said refuse bins to said different positions; input conveyor means for conveying empty ones of the refuse bins, one at a time, onto the carousel means; output conveyor means for conveying filled ones of the refuse bins, one at a time, from the carousel means; and control means for controlling the drive means to move an empty one of the refuse bins to the deposit position at predetermined time periods, and when a bin at the deposit position is filled to a predetermined level.

Specifically, bin level sensor means is provided for sensing when a refuse bin at the deposit position is filled to the predetermined level, wherein the control means controls the drive means to move an empty one of the refuse bins to the deposit position in response to sensing by the bin level sensor means when the refuse bin at the deposit position is filled to the predetermined level.

Further, timer means is provided for setting the predetermined time periods, wherein the control means controls the drive means to move an empty one of the refuse bins to the deposit position at the end of each predetermined time period, in response to the timer means.

Preferably, the drive means includes means for rotatably driving the carousel means, and the control means controls the drive means to rotate the carousel means so as to move an empty one of the refuse bins to the deposit position at the predetermined time periods, and when a bin at the deposit position is filled to the predetermined level.

In order for the carousel means to stop at the correct rotational position, rotational position sensor means determines a rotational position of the carousel means, and the control means controls the drive means to stop rotation of the carousel means so that an empty one of the refuse bins is positioned at the deposit position, in response to the rotational position sensor means.

The carousel means includes a top plate containing an upper surface on which the bins are positioned, and rotatable support means for rotatably supporting the upper surface. The rotatable support means includes a central shaft rotatably mounted on a fixed surface and centrally connected to the top plate, and roller means arranged beneath a periphery of the top plate for rotatably supporting the top plate on the fixed surface. Star wheel means is centrally fixed on the upper surface of the top plate for positioning the bins on the upper surface at the different positions.

The drive means includes first gear means on the rotatable support means, second gear means mounted to a fixed surface, endless chain means connected between the first and second gear means, and drive motor means for rotatably driving the second gear means.

Adjacent the output conveyor means, a deflection wall is positioned above the top plate and extends substantially radially inward of the carousel means for forcing filled ones of the bins from the carousel means to the output conveyor means during rotation of the carousel means.

Further, the input conveyor means is inclined so as to feed empty ones of the refuse bins, one at a time, onto the carousel means by means of gravity.

Preferably, the refuse chute includes crushing/reducing means for crushing and/or reducing refuse deposited in the refuse chute. The crushing/reducing means includes a roll rotatably mounted in the refuse chute, with crushing vanes arranged on an outer surface of the roll, and chute motor means for rotating the roll. Chute lever sensor means is provided for sensing when refuse above the roll has reached a predetermined level in the refuse chute and for producing an output signal in response thereto, and the chute motor means is actuated to rotate the roll in response to the output signal.

In accordance with another aspect of the present invention, a refuse disposal and recycling apparatus for use with a high rise building having a refuse chute that is accessible from a plurality of different floors and which is open at a lower end thereof, includes carousel means for holding a plurality of refuse bins thereon at a plurality of different positions, the different positions including a deposit position directly beneath the open, lower end of the refuse chute, the carousel means including a top plate containing an upper surface on which the bins are positioned and rotatable support means for rotatably supporting the top plate; rotatable drive means for rotatably driving the top plate; input conveyor means for conveying empty ones of the refuse bins, one at a time, onto the carousel means; output conveyor means for conveying filled ones of the refuse bins, one at a time, from the carousel means; bin level sensor means for sensing when a refuse bin at the deposit position is filled to a predetermined level; timer means for setting predetermined time periods; rotational position sensor means for determining a rotational position of the carousel means; control means for controlling the rotatable drive means to automatically rotate the carousel means so as to move an empty one of the refuse bins to the deposit position at the predetermined time periods in response to the timer means and the rotational position sensor means and when a bin at the deposit position is filled to the predetermined level in response to the bin level sensor means and the rotational position sensor means; and deflection means positioned above the top plate for forcing filled ones of the bins from the top plate to the output conveyor means.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
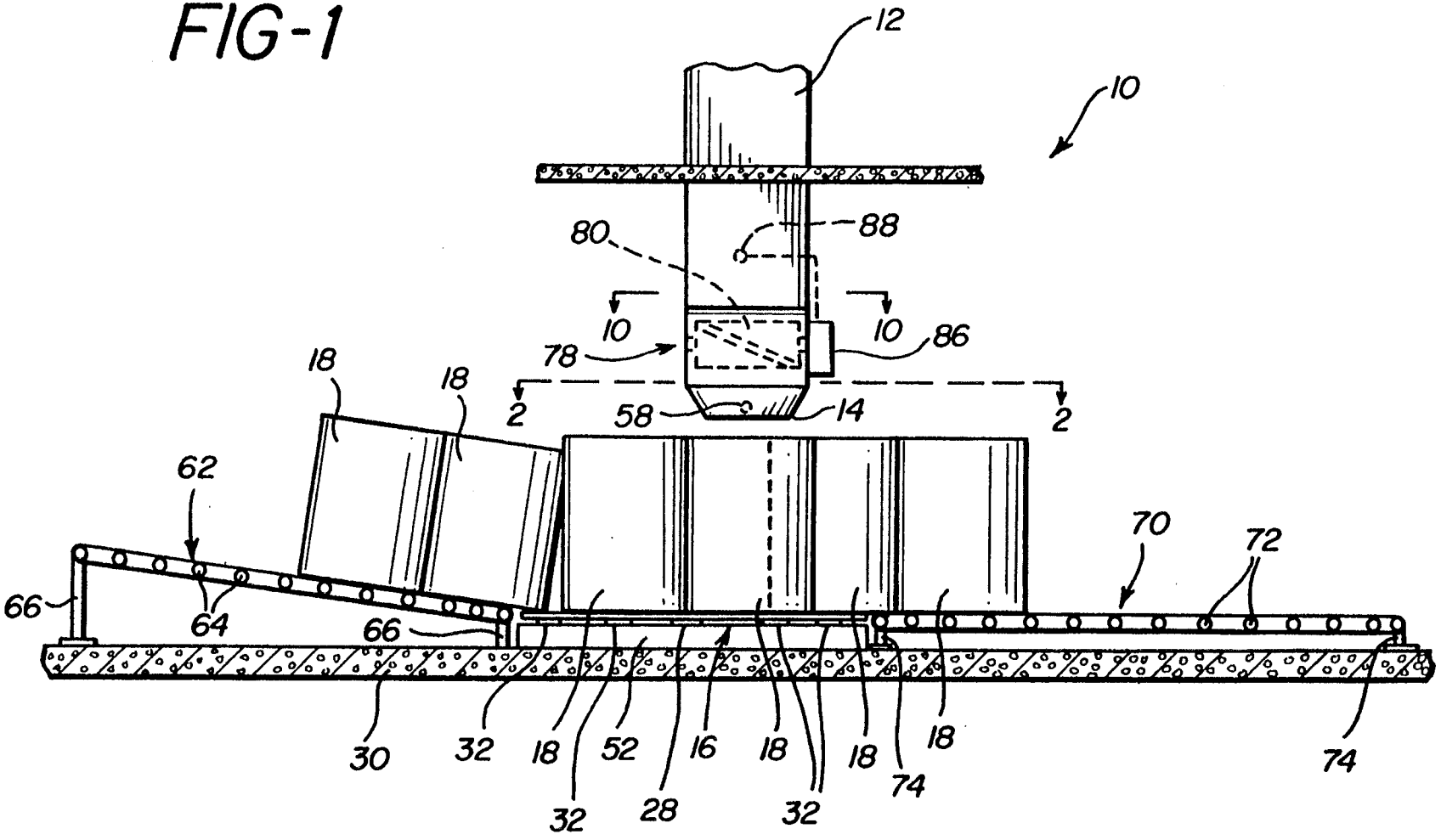
FIG. 1 is a side elevational view of a refuse disposal and recycling apparatus according to one embodiment of the present invention.

Referring to the drawings in detail, and initially to FIG. 1 thereof, a refuse disposal and recycling apparatus 10 according to one embodiment of the present invention is shown. Refuse disposal and recycling apparatus 10 is specifically adapted for use with a high rise building having a refuse chute 12 that generally extends the height of the building and is accessible from a plurality of different floors, with refuse chute 12 being open at its lower end 14.

Figure 2:
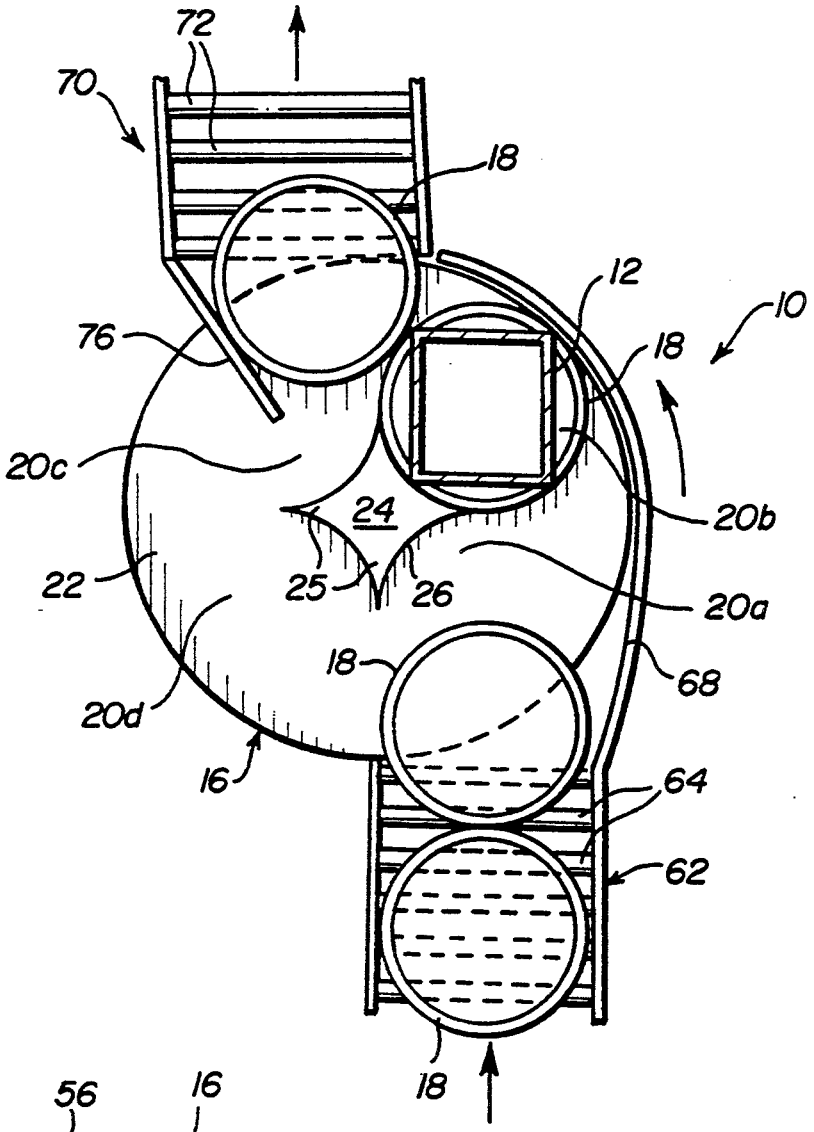
FIG. 2 is a top plan of the apparatus of FIG. 1, viewed along line 2—2 of FIG. 1.

A carousel 16 is provided below open, lower end 14 of refuse chute 12 for holding a plurality of refuse bins 18 thereon at a plurality of different positions 20*a*–20*d*, including a deposit position 20*b* directly beneath open, lower end 14 of refuse chute 12. This is best shown in FIG. 2. Although four different positions 20*a*–20*d* are shown, it will be appreciated that the present invention is not limited thereby, and more than four positions or less than four positions can be provided, depending upon the space requirements for carousel 16 and the infeed and outfeed positions for carousel 16.

Carousel 16 includes a top plate 22 made of a rigid material, such as a ⅜ inch metal plate, on which refuse bins 18 are positioned. Top plate 22 can have any suitable diameter, and preferably has a diameter on the order of approximately 84 inches. In order to correctly align refuse bins 18 with positions 20*a*–20*d*, a star wheel 24 is fixed centrally on the upper surface of top plate 22 and includes four arcuate outer surfaces 26 that receive and align barrel-shaped bins 18 at positions 20*a*–20*d* on top plate 22. It will be appreciated that position 20*d* is not utilized in the arrangement of FIG. 2.

Figure 3:
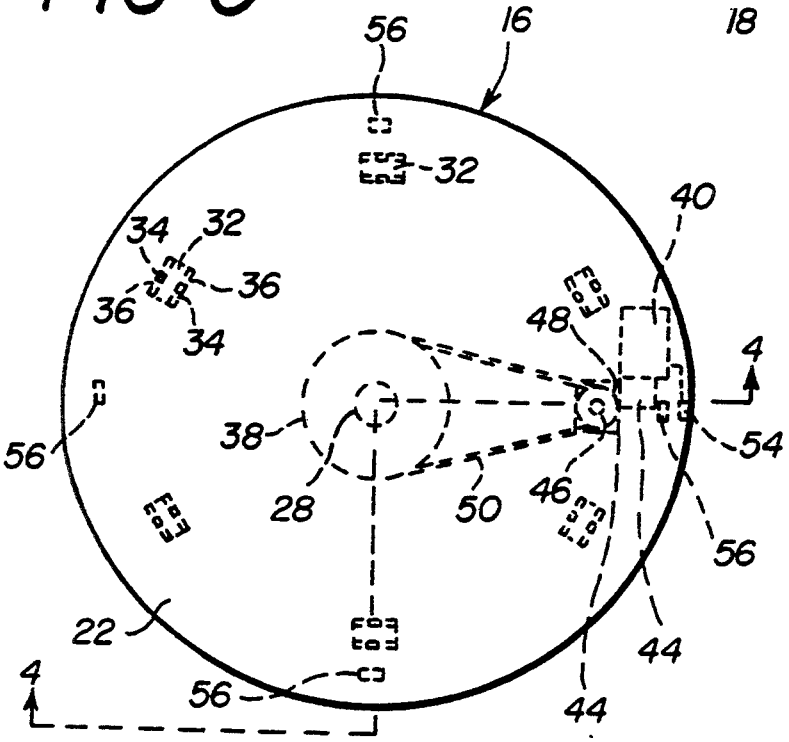
FIG. 3 is a top plan view of the carousel of FIG. 1, with the star wheel removed.
Figure 4:
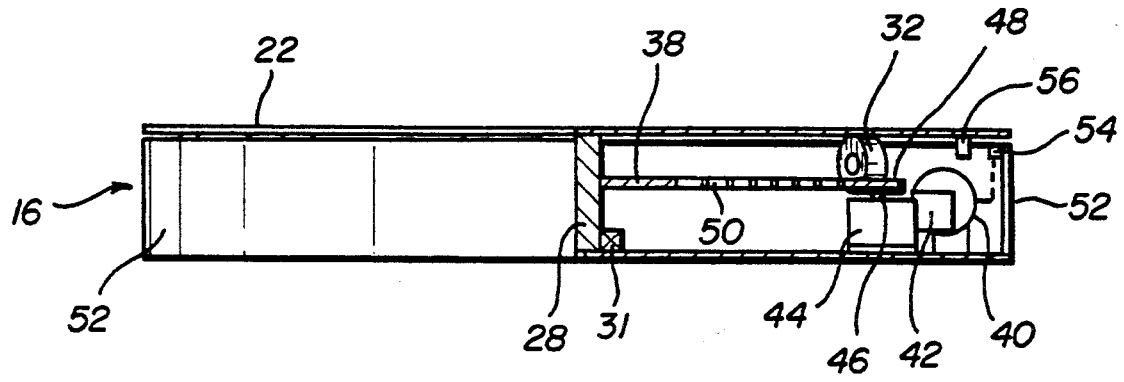
FIG. 4 is a cross-sectional view of the carousel of FIG. 3, taken along line 4—4 thereof.

As shown in FIGS. 3 and 4, top plate 22 is supported by a central shaft 28 which is rotatably mounted on floor 30 below open, lower end 14 of refuse chute 12, by means of bearings 31. Further, the periphery of top plate 22 is supported by rollers 32 equiangularly positioned beneath top plate 22. Rollers 32 can be rotatably mounted on floor 30 by any suitable means. For example, rollers 32 can have stub shafts 34 which are rotatably journalled in side supporting walls 36 on opposite sides of each roller 32, as shown in dashed lines in FIG. 3. Stub shafts 34 and side supporting walls 36 are not shown in FIG. 4 for the sake of simplicity and clarity in the drawing. Although six rollers 32 are shown, this number may vary within the scope of the present invention.

A sprocket or gear 38 is mounted on central shaft 28. A carousel drive motor 40 is mounted on floor 30, and is connected through a gear reducing assembly 42 to a gear box 44 having an output shaft 46 extending vertically upward therefrom. A smaller sprocket or gear 48 is fixed to the free upper end of output shaft 36. Sprockets 38 and 48 are coplanar and an endless chain 50 extends about sprockets 38 and 48. Further, a base enclosure wall 52 having a diameter substantially identical with the diameter of top plate 22, is provided below the periphery of top plate 22, so as to enclose elements 28 and 38–50.

Accordingly, when carousel drive motor 40 is activated, output shaft 46 and sprocket 48 are rotated, thereby rotatably driving central shaft 28 and top plate 22 by means of endless chain 50 and sprocket 38. It will be appreciated that, while sprockets 38 and 48 and endless chain 50 have been described, other arrangements for rotatably driving top plate 22 can be provided. For example, sprockets 38 and 48 can be replaced with pulleys, and endless chain 50 can be replaced with an endless belt. Alternatively, carousel drive motor 40 can be used to directly drive central shaft 28 through suitable gearing.

Figure 5:
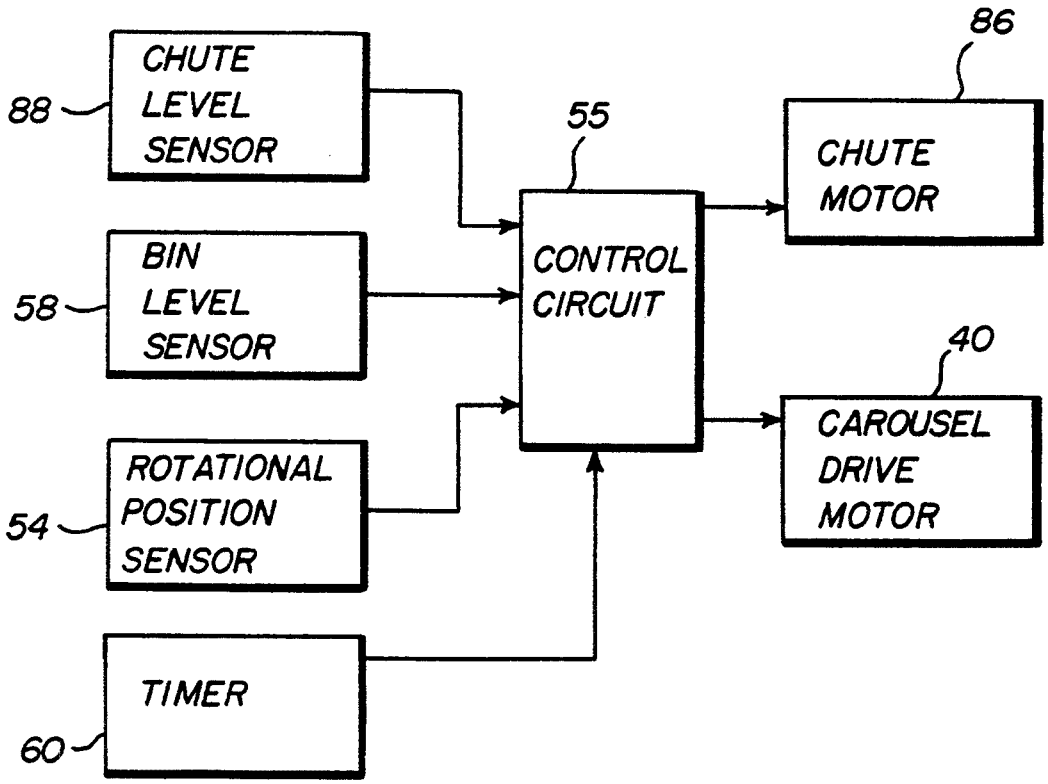
FIG. 5 is block diagram of the circuitry for controlling the operation of the refuse disposal and recycling apparatus according to the present invention.

In order to detect and control the rotational position of top plate 22, a rotational position sensor unit 54 is mounted to the inner surface at the upper end of base enclosure wall 52. Four detection posts 56 or the like are equiangularly mounted to the underside of top plate 22, spaced inwardly from the periphery thereof, and in direct opposition to rotational position sensor unit 54 when rotationally aligned therewith. Thus, carousel drive motor 40 is actuated until rotational position sensor unit 54 senses a detection post 56, whereupon actuation of carousel drive motor 40 is stopped. Specifically, when a detection post 56 is moved into opposition with rotational position sensor unit 54, the latter rotational position sensor unit 54 supplies a signal to a control circuit 55 (FIG. 5) that deactivates carousel drive motor 40, and thereby stops rotation of top plate 22 at a desired position. In this manner, top plate 22 is rotated in 90° increments. Of course, the angular incremental rotation of top plate 22 will vary depending upon the number of positions 20*a*–20*d* on top plate 22.

Rotational position sensor unit 54 can be any suitable means, such as a photoemitter/photodetector which directs a beam of light radially inward and detects a reflection from the respective detection post 56. Alternatively, each detection post 56 can include a phototransmitter, such as a light emitting diode (LED), and rotational position sensor unit 54 can include a photodetector. However, any other suitable sensing means can be utilized to detect when top plate 22 is rotated by one angular incremental position.

Carousel drive motor 40 is actuated in two different ways to rotate top plate 22 by one position.

First, a bin level sensor unit 58 is mounted to the lower end 14 of refuse chute 12, as shown in FIG. 1, to detect when the height of the refuse within refuse bin 18 reaches a predetermined height. Bin level sensor unit 58 can be any suitable means, such as a radar distance detecting device or the like, which is pointed into the bin and which detects a reflected wave therefrom. Alternatively, other arrangements which are well known can be used to detect when the height of the refuse within bin 18 reaches the predetermined height. This can be accomplished, for example, by providing a photoelectric sensor on the inside of chute 12, along with a door on the open, lower end 14 of chute 12 which is opened by a motor when a certain level of refuse is deposited in chute 12. In such case, since the capacity of bins 18 are known and since the amount of refuse retained in chute 12 between the chute door and the photoelectric sensor is known, the number of chute loads can be correlated to the capacity of bins 18 to determine when a bin 18 is filled to a predetermined level. As another example, each bin 18 can be provided with a photoelectric sensing device to determine when the bin is filled to a predetermined level.

When the height of the refuse within bin 18 is at a predetermined height or level, bin level sensor unit 58 provides an output signal which is supplied to control circuit 55, which in turn, actuates carousel drive motor 40 in order to rotate top plate 22 by a predetermined angular amount, for example, 90°. In this manner, the full bin 18 at deposit position 20*b* is moved to the next position 20*c*, and an empty bin at position 20*a* is moved to the deposit position 20*b* to be filled. As described above, when the next detection post 56 is moved into opposition with rotational position sensor unit 54, power to carousel drive motor 40 is stopped in order to stop rotation of top plate 22. In this manner, top plate 22 is only rotated for a predetermined angular amount.

The second way that carousel drive motor 40 is actuated to rotate top plate 22 is in response to a signal from a timer 60. Specifically, after a predetermined amount of time, for example two hours, as determined by timer 60, the latter timer 60 outputs a signal to control circuit 55 which actuates carousel drive motor 40 to rotate top plate 22 by a predetermined angular amount, for example, 90°. In this manner, the bin 18 at deposit position **20*b*, which may or may not be completely filled, is moved to the next position 20*c*, and an empty bin at position 20*a* is moved to the deposit position 20*b* to be filled. As described above, when the next detection post 56 is moved into opposition with rotational position sensor unit 54, power to carousel drive motor 40 is stopped in order to stop rotation of top plate 22. In this manner, top plate 22** is only rotated for a predetermined angular amount.

The latter manner of operation occurs when it is desired that only certain types of refuse be deposited in refuse chute 12 at certain times. For example, if aluminum refuse is to be deposited between the hours of 12:00 p.m. and 4:00 p.m. each day and hard plastic refuse is to be deposited between the hours of 4:00 p.m. and 8:00 p.m. each day, timer 60 would send a signal to control circuit 55 at 4:00 p.m. to cause carousel drive motor 40 to rotate top plate 22 at this time in order to provide an empty bin 18 below open, lower end 14 of refuse chute 12. Therefore, even if the aluminum refuse occupies one-half the height of the bin 18 at 4:00 p.m., this bin is moved to position **20*c*, so that the hard plastic refuse deposited in chute 12** after 4:00 p.m. will not be intermixed with the aluminum refuse.

In order to supply empty bins 18 to top plate 22 of carousel 16, an infeed conveyor 62 comprised of a plurality of freely rotatable conveyor rollers 64 is provided, as shown in FIGS. 1 and 2. Infeed conveyor 62 is set on an incline by infeed conveyor supports 66 such that empty bins 18 normally flow toward carousel 16, and thereby automatically supply empty bins 18, one at a time, to position **20*a* on top plate 22. As shown best in FIG. 2, a guide rail 68 is provided as an extension of infeed conveyor 62 and extends partially around top plate 22, at a height above top plate 22, so as to guide each empty bin 18 against an arcuate outer surface 26 of star wheel 24. In this manner, when the empty bin 18 at position 20*a* is eventually moved to deposit position 20*b*, it is accurately aligned directly below refuse chute 12**.

In like manner, in order to remove full bins 18 from top plate 22 of carousel 16, an outfeed conveyor 70 comprised of a plurality of freely rotatable conveyor rollers 72 is provided, as shown in FIGS. 1 and 2. Outfeed conveyor 70 is positioned adjacent the free end of guide rail 68. In addition, outfeed conveyor 70 is supported on floor 30 by outfeed conveyor supports 74.

As each full bin 18 is moved from deposit position **20*b* to position 20*c*, the full bin 18 abuts against a deflection wall 76 that extends substantially radially inward by a predetermined amount of top plate 22. It will be appreciated that deflection wall 76 does not extend sufficiently inward of top plate 22 to interfere with rotation of star wheel 24. During continued rotation, an apex portion 25 of star wheel 24 pushes the full bin 18 against deflection wall 76. Because of the angle and position of deflection wall 76, the full bin 18 is pushed partially onto outfeed conveyor 70. During the next intermittent rotation, the next full bin 18 pushes the bin 18 which is partially on outfeed conveyor 70 entirely onto outfeed conveyor 70**.

The general operation of the above-described apparatus is as follows. Time periods are set within which the residents of the high rise building can deposit certain types of refuse within chute 12. As an example, the following schedule can be used:

| Start Time | Stop Time | Type of Refuse |
|---|---|---|
| 8:00 a.m. | 11:00 a.m. | Glass bottles |
| 11:00 a.m. | 2:00 p.m. | Plastic |
| 2:00 p.m. | 5:00 p.m. | Aluminum |
| 5:00 p.m. | 8:00 p.m. | General Refuse |
| 8:00 p.m. | 11:00 p.m. | Glass bottles |
| 11:00 p.m. | 2:00 a.m. | Plastic |
| 2:00 a.m. | 5:00 a.m. | Aluminum |
| 5:00 a.m. | 8:00 a.m. | General Refuse |

Timer 60 is set so as to send a signal to control circuit 55 to cause actuation of carousel drive motor 40, and thereby rotation of top plate 22 of carousel 16 by 90° at each start time, regardless of the fill level of the bin 18 which is then directly beneath refuse chute 12. Thus, for example, at 8:00 a.m., top plate 22 is rotated by 90°, whereby the bin 18 then under chute 12 at position **20*b* is moved to position 20*c*, and a new bin then at position 20*a* is moved under chute 12 to position 20*b*. Assume that, at 8:45 a.m., glass bottles fill up the new bin 18 under chute 12. This is detected by bin level sensor unit 58, which supplies a signal to control circuit 55, so as to actuate carousel drive motor 40 to cause rotation of top plate 22 of carousel 16 by 90°. As a result, a new empty bin 18 is moved from position 20*a* to position 20*b*. As each bin 18 fills up, top plate 22 is rotated by 90° so that a new bin is positioned below refuse chute 12. At 11:00 a.m., regardless of the filled capacity of the refuse bin 18 then at deposit position 20*b*, top plate 22 is rotated by 90° to supply an empty bin to deposit position 20*b*** for receipt of plastic refuse.

As a result, apparatus 10 not only provides residents of high rise buildings with an efficient means of refuse disposal, but it also provides the residents with a sanitary and convenient way of complying with local recycling laws. The various cycles of operation can easily be varied to accommodate different needs. For example, two hour, four hour or different cycles can be set by timer 60 for the deposit of refuse within chute 12. Further, timer 60 can be set for hourly, daily, or even weekly schedules.

It will be appreciated that various different arrangements can be provided for carousel 16 within the scope of the present invention.

Figure 6:
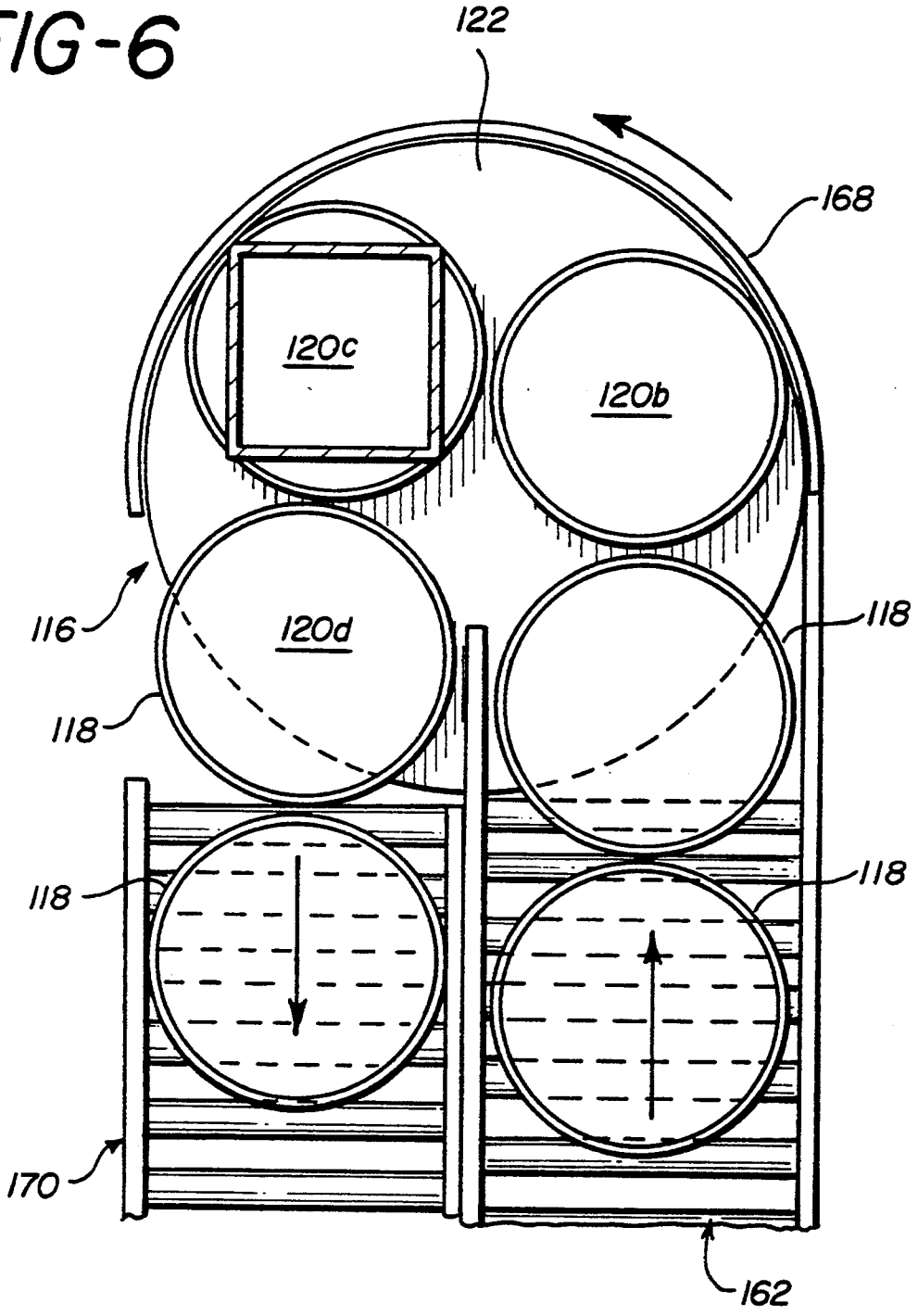
FIG. 6 is a top plan view, similar to FIG. 2, of a refuse disposal and recycling apparatus according to another embodiment of the present invention.

For example, as shown in FIG. 6, a carousel 116 according to another embodiment of the present invention will now be described, in which elements corresponding to those of apparatus 10 of the first embodiment of FIG. 2 are denoted by the same reference numerals augmented by 100, and a detailed description of the common elements will be omitted herein for the sake of brevity.

As shown therein, top plate 122 does not include any star wheel. Further, infeed conveyor 162 and outfeed conveyor 170 are arranged parallel and adjacent to each other, such that filled bins 118 are removed at position **120*d*. To prevent bins 118 from escaping from top plate 112 at positions 120*b* and 120*c* and to ensure accurate positioning of bins 118 thereat, guide rail 168 is extended substantially all of the way around top plate 112, except for a small portion adjacent position 120*d*. This also ensures that the bin 118 at position 120*c* will be directly under refuse chute 112**.

Figure 7:
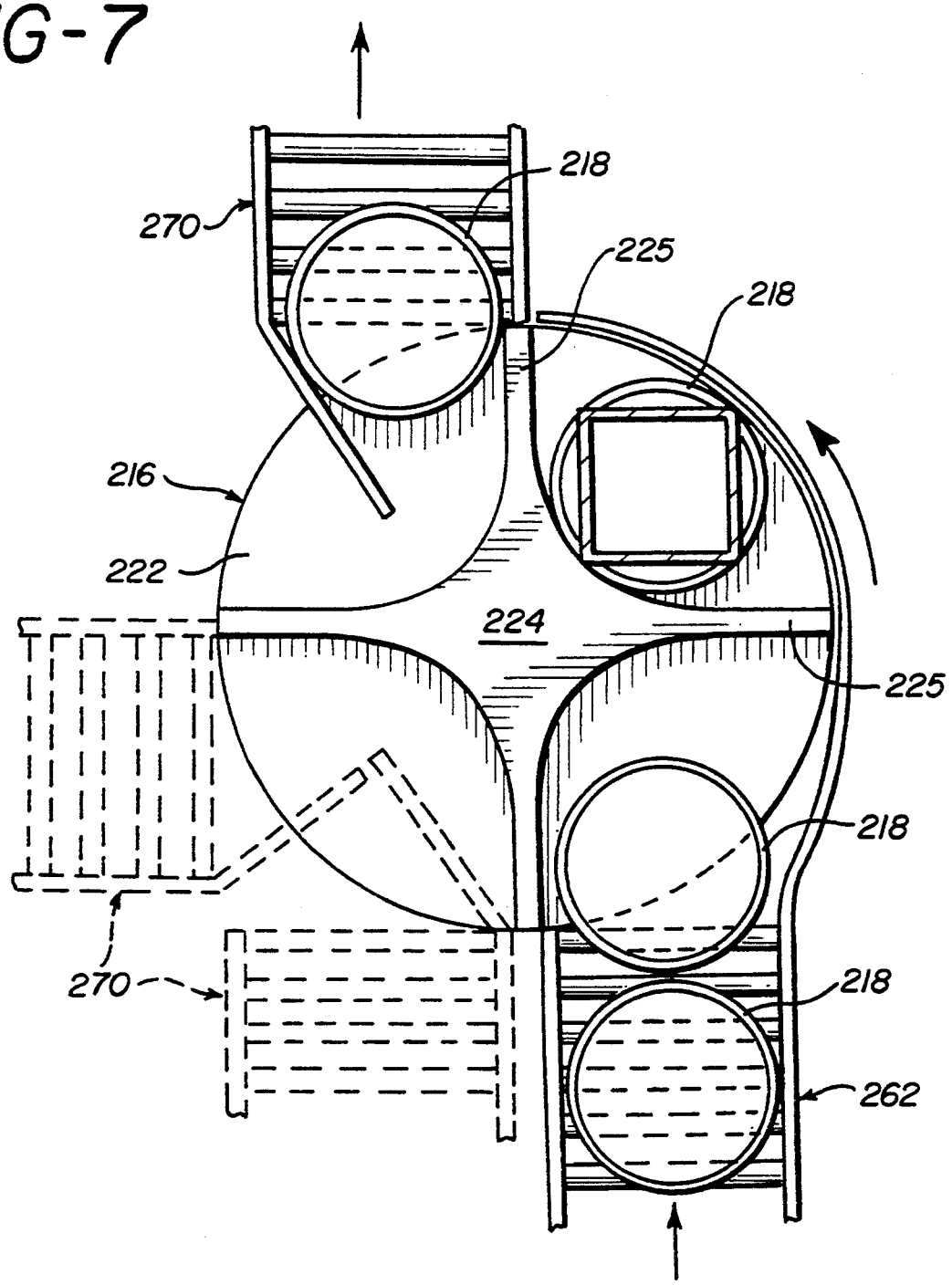
FIG. 7 is a top plan view, similar to FIG. 2, of a refuse disposal and recycling apparatus according to still another embodiment of the present invention.

As another example, as shown in FIG. 7, a carousel 216 according to another embodiment of the present invention will now be described, in which elements corresponding to those of apparatus 10 of the first embodiment of FIG. 2 are denoted by the same reference numerals augmented by 200, and a detailed description of the common elements will be omitted herein for the sake of brevity.

As shown therein, apex portions 225 of star wheel 224 are extended to the periphery of top plate 222. Thus, rather than bins 218 being in contact, they are separated by extended apex portions 225. In this manner, extended apex portions 225 are used to completely push filled bins 218 entirely off of top plate 222 and onto outfeed conveyor 270. Further, as shown in FIG. 7, outfeed conveyor 270 is shown in dashed lines to illustrate different positions where outfeed conveyor 270 can be positioned, relative to infeed conveyor 262.

Although the carousels have been described as including a rotatable top plate, any other suitable means may be used for automatically moving the bins to the different positions. For example, a circular belt conveyor arrangement can be provided, with a drive for moving the conveyor. Alternatively, a roller conveyor arrangement can be provided, with a pusher that pushes bins 18 therealong to the different positions. These and other alternate embodiments are intended to be encompassed by the recited carousel and drive therefor.

Figure 8:
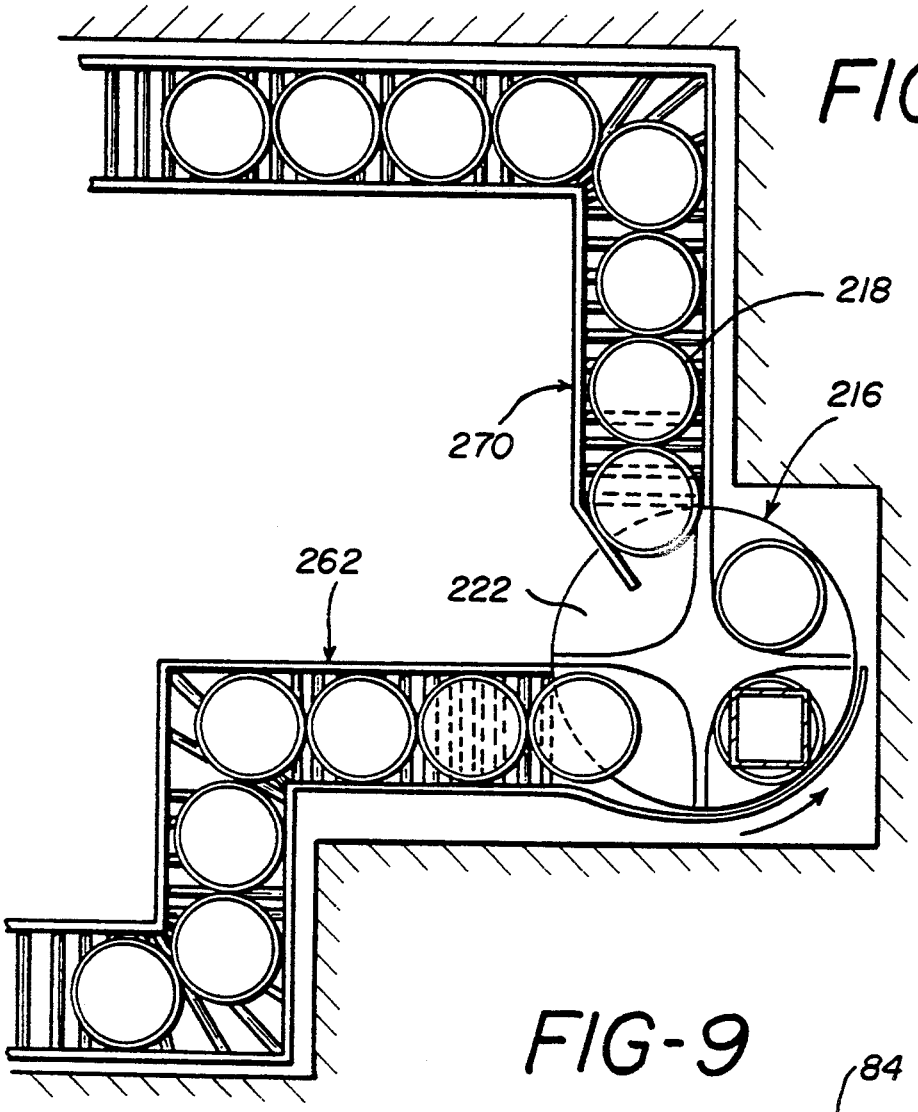
FIG. 8 is a top plan view of the refuse disposal and recycling apparatus of FIG. 7, showing the infeed and outfeed conveyors extended in a room.
Figure 9:
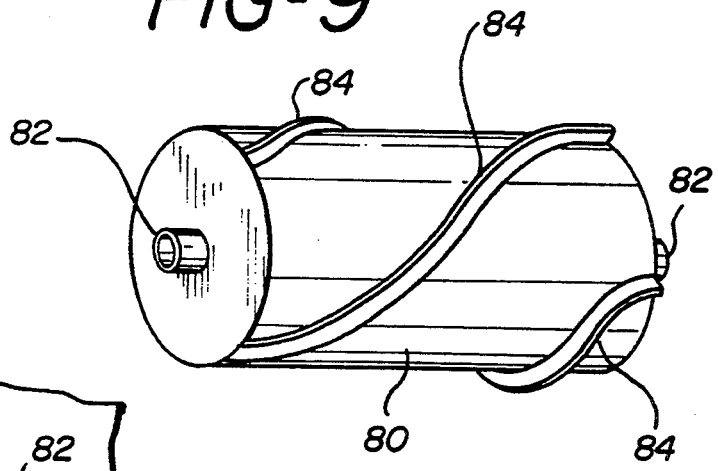
FIG. 9 is a perspective view of the roll and crushing vanes of the crushing/reduction device.
Figure 10:
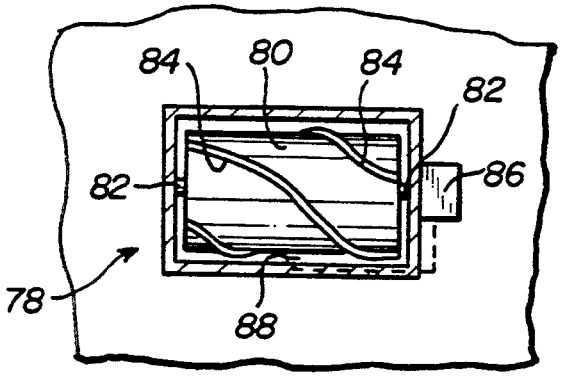
FIG. 10 is a cross-sectional view through the refuse chute of FIG. 1, taken along line 10—10 thereof, showing the crushing/reduction device.

It will be appreciated that, with the present invention, infeed conveyor 62 and outfeed conveyor 70 can be arranged over a large area, in a multitude of different arrangements, for automatic supply of empty bins to the carousel and for automatic removal of filled bins from the carousel, as shown, for example, in FIG. 8.

Referring now to FIGS. 1, 5, 9 and 10, it is preferable that refuse chute 12 be provided with a crushing/reduction device 78 that crushes and reduces the size of large objects. For example, crushing/reduction device 78 will break glass jars, crush aluminum cans and plastic bottles and the like. One example of a crushing/reduction device 78 includes a roll 80 rotatably journalled by stub shafts 82 within chute 12. A plurality of crushing vanes 84 are arranged on the outer surface of roll 80 such that there is a small space between crushing vanes 84 and the inner surface of refuse chute 12 when roll 80 is rotated. A chute motor 86 is fixed to the outer surface of chute 12 for rotating roll 80, for example, at a speed which is preferably equal to or less than 60 rpm. Thus, when roll 80 is rotated by chute motor 86, small items of refuse will readily fit between roll 80 and the inner surface of chute 12. However, larger items of refuse which do not fit therebetween, are crushed against the inner surface of refuse chute 12 by crushing vanes 84, so as to break these items into smaller pieces that fall between roll 80 and the inner surface of refuse chute 12.

Preferably, roll 80 is not continuously rotated. Rather, a chute level sensor 88 comprised of a photocell or the like, is positioned on the inner surface of chute 12 at a predetermined height above roll 80. Accordingly, large items of refuse will build up on top of roll 80. When a certain level is achieved, chute level sensor 88 supplies a signal to control circuit 55, which operates chute motor 86 to rotate for a predetermined period of time. As a result, the level of the refuse diminishes. When the level again rises, chute level sensor 88 again supplies a signal to control circuit 55. In order to prevent the commingling of different types of refuse, control circuit 55, in response to a signal from timer 60, can operate chute motor 86 at a change-over period for a different type of refuse, to ensure that all of the refuse of one type in chute 12 is removed therefrom, prior to permitting deposit of refuse of another type.

Thus, the present invention provides a refuse disposal and recycling apparatus for high rise buildings which is fully automatic. In this regard, conventional barrel-shaped bins are automatically deposited on and removed from a carousel positioned below the refuse chute. Specifically, a new bin automatically replaces a bin under the refuse chute that is filled to a predetermined level. Thus, with the present invention, a plurality of residents can use the system at the same time, provided that the same type of refuse is being deposited within the chute. The present invention therefore provides a refuse disposal and recycling apparatus for high rise buildings that is relatively economical, while using an existing refuse chute of a high rise building.

It will be appreciated that various changes and additions can be made to the present invention within the scope of the claims. For example, the doors to the refuse chute, which are provided on each floor, can be locked by a solenoid plunger or the like, during the changing of bins.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A refuse disposal and recycling apparatus for use with a high rise building having a refuse chute that extends in a generally vertical manner through the building, is accessible from a plurality of different floors of the building and is open at a lower end thereof, said refuse disposal and recycling apparatus comprising:

carousel means for holding a plurality of refuse bins thereon at a plurality of different positions at a common level of the building, said different positions including a deposit position directly beneath the open, lower end of said refuse chute;

drive means for moving said refuse bins to said different positions;

input conveyor means for conveying empty ones of said refuse bins, one at a time, onto said carousel means;

output conveyor means for conveying filled ones of said refuse bins, one at a time, from said carousel means; and control means for controlling said drive means to move an empty one of said refuse bins to said deposit position:

at predetermined time periods, and when a bin at said deposit position is filled to a predetermined level.

2. A refuse disposal and recycling apparatus according to claim 1, further including bin level sensor means for sensing when a refuse bin at said deposit position is filled to the predetermined level, and wherein said control means controls said drive means to move an empty one of said refuse bins to said deposit position in response to sensing by said bin level sensor means when the refuse bin at said deposit position is filled to said predetermined level.

3. A refuse disposal and recycling apparatus according to claim 1, further including timer means for setting said predetermined time periods, and wherein said control means controls said drive means to move an empty one of said refuse bins to said deposit position at the end of each said predetermined time period, in response to said timer means.

4. A refuse disposal and recycling apparatus according to claim 1, wherein said drive means includes means for rotatably driving said carousel means, and said control means controls said drive means to rotate said carousel means so as to move an empty one of said refuse bins to said deposit position at said predetermined time periods, and when a bin at said deposit position is filled to the predetermined level.

5. A refuse disposal and recycling apparatus according to claim 4, further including rotational position sensor means for determining a rotational position of said carousel means, and said control means controls said drive means to stop rotation of said carousel means so that an empty one of said refuse bins is positioned at said deposit position, in response to said rotational position sensor means.

6. A refuse disposal and recycling apparatus according to claim 1, wherein said carousel means includes:

an upper surface on which said bins are positioned, and rotatable support means for rotatably supporting said upper surface.

7. A refuse disposal and recycling apparatus according to claim 6, wherein said drive means includes:

first gear means on said rotatable support means, second gear means mounted to a fixed surface, endless chain means connected between said first and second gear means, and drive motor means for rotatably driving said second gear means.

8. A refuse disposal and recycling apparatus according to claim 6, wherein said carousel means includes a top plate containing said upper surface, and said rotatable support means includes a central shaft rotatably mounted on a fixed surface and centrally connected to said top plate.

9. A refuse disposal and recycling apparatus according to claim 8, wherein said rotatable support means further includes roller means arranged beneath a periphery of said top plate for rotatably supporting said top plate on said fixed surface.

10. A refuse disposal and recycling apparatus according to claim 6, wherein said carousel means further includes star wheel means centrally fixed on said upper surface for positioning said bins on said upper surface at said different positions.

11. A refuse disposal and recycling apparatus according to claim 1, further including deflection means positioned above said carousel means for forcing filled ones of said bins from said carousel means to said output conveyor means during movement of said bins to said different positions.

12. A refuse disposal and recycling apparatus according to claim 11, wherein said deflection means includes a deflection wall extending substantially radially inward of said carousel means.

13. A refuse disposal and recycling apparatus according to claim 1, wherein said input conveyor means is inclined so as to feed empty ones of said refuse bins, one at a time, onto said carousel means by means of gravity.

14. A refuse disposal and recycling apparatus according to claim 1, further including crushing/reducing means, in a lower portion of the refuse chute, for at least one of crushing and reducing refuse deposited in said refuse chute.

15. A refuse disposal and recycling apparatus according to claim 14, wherein said crushing/reducing means includes a roll rotatably mounted in said refuse chute, and chute motor means for rotating said roll.

16. A refuse disposal and recycling apparatus according to claim 14, wherein said crushing/reducing means further includes crushing vanes arranged on an outer surface of said roll.

17. A refuse disposal and recycling apparatus according to claim 14, further including chute lever sensor means for sensing when refuse above said roll has reached a predetermined level in said refuse chute and for producing an output signal in response thereto, and said chute motor means is actuated to rotate said roll in response to said output signal.

18. A refuse disposal and recycling apparatus for use with a high rise building having a refuse chute that extends in a generally vertical manner through the building, is accessible from a plurality of different floors of the building and is open at a lower end thereof, said refuse disposal and recycling apparatus comprising:

carousel means for holding a plurality of refuse bins thereon at a plurality of different positions at a common level of the building, said different positions including a deposit position directly beneath the open, lower end of said refuse chute, said carousel means including a top plate containing an upper surface on which said bins are positioned and rotatable support means for rotatably supporting said top plate;

rotatable drive means for rotatably driving said top plate;

input conveyor means for conveying empty ones of said refuse bins, one at a time, onto said carousel means;

output conveyor means for conveying filled ones of said refuse bins, one at a time, from said carousel means; bin level sensor means for sensing when a refuse bin at said deposit position is filled to a predetermined level;

timer means for setting predetermined time periods;

rotational position sensor means for determining a rotational position of said carousel means;

control means for controlling said rotatable drive means to rotate said carousel means so as to move an empty one of said refuse bins to said deposit position:

at the predetermined time periods, in response to said timer means and said rotational position sensor means, and when a bin at said deposit position is filled to the predetermined level, in response to said bin level sensor means and said rotational position sensor means; and deflection means positioned above said top plate for forcing filled ones of said bins from said top plate to said output conveyor means.

19. A refuse disposal and recycling apparatus according to claim 18, wherein said rotatable support means includes a central shaft rotatably mounted on a fixed surface and centrally connected to said top plate; and said rotatable drive means includes:

first gear means on said central shaft, second gear means mounted to the fixed surface, endless chain means connected between said first and second gear means, and drive motor means for rotatably driving said second gear means.

20. A refuse disposal and recycling apparatus according to claim 18, wherein said carousel means further includes star wheel means centrally fixed on said upper surface for positioning said bins at said different positions on said upper surface.

21. A refuse disposal and recycling apparatus according to claim 18, wherein said deflection means includes a deflection wall extending substantially radially inward of said top plate.

22. A refuse disposal and recycling apparatus according to claim 18, wherein said input conveyor means is inclined so as to feed empty ones of said refuse bins, one at a time, onto said top plate by means of gravity.

* * * * *